United States Patent [19]

Aggio

[11] Patent Number: 4,466,860

[45] Date of Patent: Aug. 21, 1984

[54] METHOD FOR PRODUCING ETCHED PATTERNS ON TEXTILE FABRICS

[76] Inventor: Giordano Aggio, 163/1 Via S. Faustino, 41100 Modena, Italy

[21] Appl. No.: 304,257

[22] Filed: Sep. 21, 1981

[51] Int. Cl.[3] ..... B44C 1/22

[52] U.S. Cl. ..... 156/655; 156/654; 428/196; 428/224; 428/229; 428/245; 428/260

[58] Field of Search ..... 156/635, 668, 654, 655; 428/224, 229, 245, 260, 196

[56] References Cited

U.S. PATENT DOCUMENTS 1,804,529 5/1931 Dreyfus ..... 156/654
4,352,380 10/1982 Owen et al. .

FOREIGN PATENT DOCUMENTS 683622 12/1952 United Kingdom ..... 156/655

*Primary Examiner*—James J. Bell
*Attorney, Agent, or Firm*—Lowe, King, Price & Becker

[57] ABSTRACT

A method of chemically etching textile fabrics having a weave of cotton fibers and polyester or nylon fibers to produce etched patterns is disclosed. According to the method, areas of the textile fabric are treated with a chemical composition which is reactive with the cotton fibers but not with the polyester or nylon fibers. The treated textile fabric is then heated to dry the chemical composition on the fabric to prevent distribution of the chemical into untreated fabric areas. Heat and pressure is then applied to the fabric to cause the chemical composition to react with and dissolve or otherwise destroy the cotton fibers. After press-heating, the treated textile fabric is washed to remove the cotton and chemical composition from the fabric, leaving the polyester or nylon fibers intact to produce the desired etched pattern. An article of manufacture having a substrate and chemical composition disposed thereon can also be positioned on the fabric. Application of heat and pressure in a heat transfer machine causes the chemical composition to destroy the cotton fibers to produce the desired etched pattern.

13 Claims, No Drawings

METHOD FOR PRODUCING ETCHED PATTERNS ON TEXTILE FABRICS

TECHNICAL FIELD

This invention generally relates to methods and articles of manufacture for producing ornamental designs and patterns of textile fabrics and, more particularly, to a method and article of manufacture for producing etched ornamental designs and patterns on textile fabrics having a weave including cotton and polyester or nylon fibers.

BACKGROUND ART

Printing of ornamental design patterns and words on textile fabrics, such as Tee-shirts and the like, is known to visually convey art work and/or information. Commercially, such art work and/or words can be applied to the textile fabric by means of known screen printing or heat transfer techniques to produce the desired image on the fabric. In both screen printing and heat transfer, one or more thin layers of ink are applied to the printing surface of the uniformly thin fabric and, after drying, the farbic can then be worn. Of course, multi-colored patterns can also be obtained with screen printing or heat transfer techniques.

Other types of visual effects can also be produced on textile garments. For example, the garment can be embroidered with colored threads to achieve desired patterns. Generally speaking, however, other types of visual pattern effects produced on textile garments of which I am aware are limited and often difficult or expensive to produce.

It is accordingly an object of the present invention to provide a method of chemically etching a single textile fabric to produce a desired etched pattern therein.

Another object is to provide a method wherein a chemical composition reactive with cotton fibers of the textile fabric can be applied with known screen printing equipment.

Still a further object is to provide an article of manufacture wherein chemical composition reactive with cotton fibers of the textile fabric can be applied to the fabric with known heat transfer equipment.

Still a further object is to provide a method for etching textile garments to achieve a semi-transparent effect in predetermined areas at a relatively low manufacturing cost.

DISCLOSURE OF INVENTION

A method of chemically etching textile fabrics having a weave of cotton fibers and polyester or nylon fibers to produce etched patterns in the textile fabric is disclosed. According to the method, the textile fabric is treated in preselected fabric areas with a chemical composition which is reactive with the cotton fibers but not with the polyester or nylon fibers. A predetermined amount of pressure and heat within a predetermined temperature range is applied to the treated textile fabric for a predetermined duration to cause the chemical composition to react with and destroy the cotton fibers. The treated textile fabric is then washed to remove the destroyed cotton and chemical composition, leaving the polyester or nylon fiber weave intact to produce the etched, semi-transparent pattern in the fabric.

Preferably, prior to pressing and heating the treated textile fabric, the textile fabric is preheated to at least partially dry the chemical composition on the treated fabric, ensuring a sharp border between treated and untreated fabric areas.

According to the method of the invention, a chemical composition can be applied to the textile fabric with conventional silk screen printing machines. Additionally, a paper templet having a predetermined aperture pattern can be positioned on the textile fabric; the chemical composition can be brushed on the templet thereby treating exposed areas of the fabric with chemical.

An article of manufacture for chemically etching textile fabrics having a weave of cotton fibers and polyester or nylon fibers to produce etched patterns in the fabric is also disclosed. The article of manufacture includes a substrate and the chemical composition carried by the substrate. Positioning the chemical on the fabric by overlaying the substrates thereon and applying a predetermined amount of pressure and heat within a predetermined temperature range for a predetermined duration causes the chemical composition to react with and remove, dissolve or otherwise destroy or eliminate the cotton fibers without reacting with the polyester or nylon fibers.

BEST MODE FOR CARRYING OUT THE INVENTION

Before dealing with the method of the invention in detail it will be helpful to briefly describe a textile fabric, such as a Tee-shirt, and the nature of the finished pattern thereon. Basically, the fabric of the Tee-shirt or other garment contemplated consists of a weave of cotton fibers or filaments and, for example, polyester or nylon fibers or filaments, that have been knitted to form the T-shirt using, for example, a jersey or interweave weaving technique. Basically, weaving of the cotton and polyester or nylon filaments together in a known manner, as discussed above, produces an opaque textile material. Removal of the cotton fibers, as discussed below, in predetermined areas of the textile fabric does not disturb the weave composition of the remaining polyester or nylon filaments; however, due to the absence of the cotton filaments the resulting texture obtained in the preselected areas produces a semi-transparent effect due to the spacing between the remaining synthetic fibers in the preselected areas.

To dissolve or otherwise eliminate the cotton filaments in the preselected areas of the garment, I apply to the garment, in a manner discussed below a chemical composition containing 180 grams of sodium bisulfate (NHASO4); glycerin, 20 grams; water, 250 grams; PA3, 500 grams (available from Hercules Incorporated, 910 Market Street, Wilmington, Delaware); emulsifying agent, 30 grams; and a penetrant, 20 grams. The foregoing quantities of chemical components produce one kilogram of chemical composition to be applied to the textile fabric. Of course, varying the quantities while maintaining the ratios of components enables the user to prepare a predetermined amount of chemical composition for application to the textile fabric.

To obtain chemically etched textile fabrics it is necessary to treat the fabric with the foregoing chemical composition which is reactive with the cotton fibers but not with the polyester or nylon fibers woven into the fabric. Moreover, to achieve a desired etched pattern in the fabric, it is necessary to treat exposed areas of the textile fabric.

I have found that such treating can be established with conventional silk screening equipment. For example, the textile fabric is positioned upon a support surface located beneath for registration with a printing screen. The printing screen is also in registration with the fabric surface when positioned thereon during screen printing. The screen includes preselected areas enabling the chemical to pass through onto the textile fabric during screening.

To treat the fabric with conventional silk screen printing equipment discussed above, the chemical composition is applied to the upper surface of the screen fabric. A squeegee applying equal pressure to all points of the screen impresses the chemical composition through the preselected screen areas causing the chemical to pass through the screen onto the fabric.

After treating the fabric in the manner described above, it will be understood that preselected fabric areas corresponding to the preselected screen areas will become saturated with the chemical composition. The chemical composition is in a wet state.

To cause the chemical composition to chemically react with the treated textile fabric to dissolve the cotton fibers in the preselected areas, it is necessary to heat the fabric to approximately 130° Centigrade through uniform heating of the entire treated surface area. To effect uniform heating, the treated textile fabric is press-heated in, for example, a known heat transfer machine for approximately 20–30 seconds at a pressure of approximately five atmospheres, or with manual pressure application, thereby enabling the chemical composition to completely react with and uniformly burn the cotton filaments in the preselected areas. However, because of the pressure applied directly to the farbic, it is first necessary to partially dry the chemical composition without applying pressure to prevent distribution of the chemical composition located contiguous with the untreated fabric areas from spreading into the untreated fabric areas as would otherwise occur under pressure. For the purpose of drying the chemical composition in the treated areas prior to press-heating, to achieve the desired borders between treated and untreated textile fabric areas, the treated textile fabric is heated in an oven at a temperature of approximately 130° Centigrade for approximately two and a half minutes. Alternatively, an infrared source of radiation or forced hot air can be used to dry the chemical composition in the treated textile fabric areas.

Subsequent to press-heating the treated fabric areas, thereby causing a uniform chemical reaction to dissolve the cotton filaments, the heat treated fabric is washed to remove the dissolved or partially dissolved or otherwise cotton and chemical composition therefrom while leaving the polyester or nylon fibers intact to thereby produce the etched pattern described above. A washing cycle of approximately fifteen minutes is sufficient to remove the chemical composition and remnant cotton from the fabric in a fully loaded washing machine or drum.

While application of the chemical composition to exposed areas of the textile fabric can be accomplished with conventional screen printing equipment, as discussed above, other methods of chemical application are possible. For example, a paper template including apertures forming the desired pattern can be positioned on the textile fabric surface, thereby defining preselected areas for chemical treatment thereon. An adhesive film disposed on one surface of the template is briefly heated to secure the template to the fabric for proper registration therebetween. Chemical composition is then brushed onto the exposed areas of the fabric. The template is then easily removed by peeling. The treated fabric is then heated and pressed in the manner described above to produce the desired etched pattern.

The chemical composition employed in the method with this invention generally comprises:

| Component | Amount (Parts by Wt.) |
|---|---|
| Sodium Bisulfate | 150–200 |
| Glycerine | 10–30 |
| Water | 200–300 |
| Surface Active Agent | 50–100 |

(Used as a 10–20 wt. % aqueous solution)

The composition is a thick paste of good consistency which is easily applied by conventional heat transfer and silk screening techniques. In preferred aspects, an emulsifying agent is also incorporated into the composition to provide a more homogeneous mixture. Further, a penetrant or known component to cause the composition to reach the cotton fibers is also included.

The preferred composition comprises a mixture of about 180 grams with sodium, about 20 grams of glycerine, about 250 grams of a 13 wt. % solutions of PA3, a commercial surface active agent. Any emulsifier should be used in an amount of about 30 grams and the penetrant is used in an amount of about 20 grams.

After application of the chemical composition to the fabric, the treated fabric is dried by air drying or by heating up to no higher than about 150 degrees Centigrade preferably in an oven at about 100 degrees to 135 degrees Centigrade. When drying is completed, the dried fabric is heated at a temperature of about 100–150 degrees centigrade under a pressure of up to about 10 atmospheres. The temperatures for the heating and drying steps should be below any temperature that would injure the fabric; otherwise these temperatures can be varied as necessary. After completion of the heating and pressing steps, the fabric is washed to remove cotton and chemical residue to provide the product.

In accordance with the scope of the present invention, an article of manufacture for chemically etching textile fabrics having the aforementioned weave is also provided for direct application using a known heat transfer machine. The article preferably includes a substrate carrying on one surface thereof the chemical composition disposed in predetermined areas of the substrate surface. The substrate is preferably not chemically reactive with the chemical composition and therefore comprises a sheet of Mylar (manufactured by DuPont Corporation, Wilmington, Delaware) or like material. However, it will be understood that a chemically reactive substrate, such as paper can be used, provided that silicon, plastic or like film means not chemically reactive with the chemical composition is disposed between the substrate and chemical compsotion layer during manufacture of the article.

The article, similar in shape to commercially available heat transfers, is positioned in registration on the textile fabric. Pressure and heat are applied, in accordance with the temperatures and pressures set forth above, to the article and textile fabric using, for example, commercially available heat transfer machines, to impress the chemical composition into the textile fabric and cause the chemical reaction destroying the cotton filaments in the fabric to produce the desired etched pattern.

In this disclosure, there is shown and described only the preferred embodiments of the invention, but, as aforementioned, it is to be understood that the invention is capable of use in various other combinations and environments and is capable of changes or modification within the scope of the inventive concept as expressed herein.

EXAMPLE I

A fabric of 50% cotton and 50% polyester is treated by a conventional silk screening technique with a chemical composition consisting of 180 grams of sodium bisulfate, 20 grams of glycerin, 250 grams of water, and 500 grams of a commercially available surface active agent known as PA3, the PA3 being used as a 13 wt. % solution in water.

The treated fabric is then dried by heating at a temperature of 130 degrees centigrade for two hours. The dried fabric having the chemical composition thereon in selected areas is then pressed in a heat press for 30 seconds at a temperature of 130 degrees centigrade and a pressure of 5 atmospheres.

After cooling, the fabric was washed to remove the cotton residue and chemical composition to provide the fabric with the pattern thereon.

EXAMPLE II

A support substrate of plain paper is coated on one side with a film of silicon compound and allowed to dry.

The chemical composition as in Example I is coated onto preselected areas at the silicon film with a screen and allowed to dry to a paste consisting for ease of distributing the product to individual user. In application, the chemical composition is positioned in registration and contact with the textile fabric surface used in Example I in a heat transfer machine press. Manual pressure and heat of approximately 130 degrees centigrade is applied to impress the chemical composition into areas of the fabric in registration with the preselected areas to dissolve the cotton. The fabric is then washed in water to remove the destroyed cotton and chemical.

I claim:

1. A method of chemically etching textile fabrics having a weave of cotton fibers and polyester or nylon fibers to produce etched patterns in the textile fabrics, comprising the steps of: (a) treating at least one exposed area of the textile fabric with a chemical composition which is reactive with the cotton fibers but not with the polyester or nylon fibers; (b) applying a predetermined amount of pressure and heat within a predetermind temperature range for a predetermined duration to the treated textile fabric to thereby cause the chemical composition to react with and eliminate the cotton fibers without reacting with the polyester or nylon fibers; and (c) washing the treated textile fabric to thereby remove the destroyed cotton and chemical composition, leaving the polyester or nylon fibers in tact to thereby produce said etched pattern.

2. The method of claim 1, further including the step of heating the treated textile fabric to temperatures within a predetermined temperature range for a predetermined duration to at least partially dry the chemical composition on the treated fabric prior to applying said pressure.

3. The method of claim 1, further including the step of drying the chemical composition on the treated textile fabric.

4. The method according to claim 2, wherein said chemical composition is applied to exposed areas of the textile fabric during treating with screen printing equipment.

5. The method according to claim 2, wherein said chemical composition is applied to exposed areas of the textile fabric during treating with a disposable paper template having apertures defining exposed areas of the textile fabric when positioned thereon.

6. The method according to claim 5, wherein said paper template includes a film of adhesive material on the surface thereof, said adhesive surface being positioned on the fabric to temporarily secure and affix the template to the fabric for registration of the apertures on the fabric, wherein heat is applied to the template to thereby cause adhesion thereof to the fabric.

7. The method according to claim 4 or 5, wherein heat applied to the treated textile fabric during application of pressure is within a predetermined temperature range of approximately 120–130 degrees centigrade, said heat being applied for approximately 20–30 seconds.

8. The method according to claim 7, wherein heat applied to the treated textile fabric prior to application of said pressure is within a predetermined temperature range of approximately 120–130 degrees centigrade, said heat being applied for a predetermined duration of approximately 2-2-½ minutes to thereby substantially dry the chemical on the fabric and initiate reaction between the chemical composition and cotton fibers.

9. The method according to claim 8, wherein said heat being applied to at least partially dry the chemical composition is applied with an oven.

10. The method according to claim 8, wherein said heat being applied to partially dry the chemical composition is applied with infra-red means.

11. The method according to claim 8, wherein said heat being applied to at least partially dry the chemical composition is applied with hot air produced from blower means.

12. The method according to claim 1, wherein said pressure applied to the treated textile fabric is approximately 5 atmospheres.

13. The method of claim 1 wherein said chemical composition consists of a mixture of sodium bisulfate, gylcerin, water and a surface active agent.

* * * * *